US009709060B2

(12) United States Patent
Kösters

(10) Patent No.: US 9,709,060 B2
(45) Date of Patent: Jul. 18, 2017

(54) SIDE-CHANNEL PUMP AND METHOD FOR OPERATING SAME

(71) Applicant: Sterling Industry Consult GmbH, Itzehoe (DE)

(72) Inventor: Heiner Kösters, Itzehoe (DE)

(73) Assignee: Sterling Industry Consult GmbH, Itzehoe (DE)

( * ) Notice: Subject to any disclaimer, the term of this patent is extended or adjusted under 35 U.S.C. 154(b) by 301 days.

(21) Appl. No.: 14/425,169

(22) PCT Filed: Sep. 3, 2013

(86) PCT No.: PCT/EP2013/068168
§ 371 (c)(1),
(2) Date: Mar. 2, 2015

(87) PCT Pub. No.: WO2014/033317
PCT Pub. Date: Mar. 6, 2014

(65) Prior Publication Data

US 2015/0211530 A1 Jul. 30, 2015

(30) Foreign Application Priority Data

Sep. 3, 2012 (EP) ..... 12182748

(51) Int. Cl.

| | |
|---|---|
| ***F04D 15/00*** | (2006.01) |
| ***F04D 5/00*** | (2006.01) |
| ***F04D 1/06*** | (2006.01) |
| ***F04D 9/02*** | (2006.01) |
| ***F04D 29/08*** | (2006.01) |
| ***F04D 29/42*** | (2006.01) |

(52) U.S. Cl.
CPC ..... *F04D 15/0066* (2013.01); *F04D 1/06* (2013.01); *F04D 5/006* (2013.01); *F04D 9/02* (2013.01); *F04D 29/08* (2013.01); *F04D 29/42* (2013.01)

(58) Field of Classification Search
CPC ..... F04D 15/0066; F04D 1/06; F04D 5/006; F04D 9/02; F04D 29/08; F04D 29/42
See application file for complete search history.

(56) References Cited

U.S. PATENT DOCUMENTS

2009/0208346 A1* 8/2009 McLoughlin ..... F04D 15/0066 417/34

FOREIGN PATENT DOCUMENTS

| | | | |
|---|---|---|---|
| DE | 19522560 | A1 | 1/1997 |
| JP | 2002-031074 | A | 1/2002 |

OTHER PUBLICATIONS

International Search Report mailed Oct. 1, 2013 (PCT/EP2013/068168).
International Preliminary Report on Patentability dated Mar. 3, 2015 (PCT/EP2013/068168).

* cited by examiner

*Primary Examiner* — Richard Edgar
(74) *Attorney, Agent, or Firm* — Alix, Yale & Ristas, LLP

(57) ABSTRACT

The invention relates to a side-channel pump and to a method for operating a side-channel pump in which an impeller rotates in a working chamber provided with a side channel. According to the invention, the pump is operated at an overspeed with a gas-filled working chamber in a first step. The speed is then reduced to an operating speed in order to pump a liquid. The pump according to the invention has a high suction power as a result of the overspeed, but only gas is drawn initially.

19 Claims, 2 Drawing Sheets

SIDE-CHANNEL PUMP AND METHOD FOR OPERATING SAME

BACKGROUND

The invention relates to a side-channel pump and to a method for operating a side-channel pump. In the pump, an impeller rotates in a working chamber provided with a side channel.

Side-channel pumps are used to pump liquids and mixtures of liquid and gas. It is an advantage of side-channel pumps that the operation of the pump is impaired only insignificantly if even relatively large quantities of gas are carried along in the liquid.

It is also possible to draw in pure gas with the side-channel pump. This is used, for example, to draw in liquid from a tank even though the riser line is filled with gas. In the case of side-channel pumps according to the prior art, however, this is only possible if the working chamber contains a quantity of liquid. When the impeller rotates, the quantity of liquid forms a liquid ring in the working chamber, by means of which adjacent vane cells are sealed off partially with respect to one another. Although there is always a leakage gap remaining between the vane cells, it is so small that it does not counteract the intake of the gas.

SUMMARY

It is the underlying object of the invention to present a side-channel pump and a method for operating a side-channel pump which enable gas to be drawn in even when the working chamber of the pump does not contain a quantity of liquid. Starting from the prior art mentioned at the outset, the object is achieved by means of the features of the independent claims. Advantageous embodiments can be found in the dependent claims.

In the method according to the invention, the side-channel pump is operated at an overspeed with a gas-filled working chamber in a first step. In a second step, the speed is reduced to an operating speed in order to pump a liquid.

A number of terms are explained first of all. Side-channel pumps are generally designed for a maximum speed at which they can pump liquid. Overspeed refers to a speed which is above this maximum speed. The operating speed, at which the pump according to the invention pumps liquid, is no more than the maximum speed. The operating speed can also be below the maximum speed.

The working chamber of the side-channel pump is filled with gas when the working chamber does not contain a quantity of liquid which could seal the radial leakage gap between the impeller and the casing by means of a liquid ring.

With the invention, it has been recognized that gas can be pumped even without a liquid ring in the working chamber if the side-channel pump is operated at an excess speed. Compared with the normal, slow operation when pumping liquids, the pump forms as it were a high-speed blower when pumping gas, by means of which blower a good suction power is achieved despite the significant leakage gaps. If the liquid following the gas then enters the pump, the speed is reduced and liquid is pumped as with a conventional side-channel pump in normal operation.

For effective pumping of the gas, it is advantageous if the overspeed is considerably above the operating speed. For example, the overspeed can be higher than the operating speed by at least 50%, preferably by at least 70%, further preferably by at least 90%. Based on the maximum speed, the overspeed is preferably higher by at least 30%, preferably by at least 50%, further preferably by at least 70%.

On the other hand, the driving power when pumping gas is lower than when pumping liquids. When operating at overspeed, the driving power is preferably less than the driving power at operating speed by at least 10%, preferably at least 30%, further preferably at least 50%.

The operating speed and the maximum speed can be between 1200 rpm and 4000 rpm, for example. The volume flow of liquid which the pump pumps at operating speed is preferably greater than 1 $m^3/h$, further preferably greater than 10 $m^3/h$, further preferably greater than 30 $m^3/h$. The overspeed can be between 3600 rpm and 7000 rpm, for example. Particularly in the case of low-speed pumps, with which the operating speed is between 1200 rpm and 2000 rpm, the overspeed can be 3600 rpm to 5000 rpm. In the case of higher-speed pumps with an operating speed of between 2000 rpm and 4000 rpm, the overspeed can be between 5000 rpm and 7000 rpm.

The pumps according to the invention are often used in systems in which it is very important that the pumped liquid should not penetrate to the outside. It is expedient for this purpose if a side-channel pump embodied in a sealless manner is used. "In a sealless manner" means that the end of the shaft on which the drive motor acts is arranged completely within the casing of the pump. Since the shaft is not passed to the outside through the casing, there is no need for a shaft seal at this point. A magnetic clutch can be provided between the output shaft of the motor and the drive shaft of the pump. For example, the magnet of the output shaft can be arranged radially to the outside of the magnet of the drive shaft, wherein the casing is designed as a "split cage" between the two magnets.

The efficiency of the pump can be improved if use is made of a side-channel pump in which a plurality of working chambers provided with a side channel is arranged in series. The outlet opening of the first working chamber leads to the inlet opening of the second working chamber, with the result that the pumped medium passes through all the working chambers in succession. The pump is therefore multi-stage.

An impeller rotates in each working chamber. The impeller is enclosed between two end faces of the working chamber, wherein the side channel is formed in one of the end faces. The side channel corresponds to a depression in the end face, meaning that the leakage gap between the impeller and the end face is enlarged in the region of the side channel. The side channel can extend in an arcuate path from the inlet opening to the outlet opening of the working chamber. The arcuate path can correspond substantially to the path which the impeller also describes on the path from the inlet opening to the outlet opening.

If the pump is running at the overspeed as a blower and liquid then impinges upon the inlet stage of the pump, this is associated with a shock load on the pump. The inlet stage of the pump should be configured in such a way that it can withstand this shock load. The inlet stage can be a centrifugal stage, for example. In the case of a centrifugal stage, a rotor is provided with a plurality of channels which extend from a central region of the rotor to a peripheral region of the rotor. The pumping action of a centrifugal stage of this kind is obtained from the fact that the medium pumped moves through the channel from the central region to the peripheral region under the centrifugal force.

When the medium impinges upon the inlet stage in an axial direction, the medium is therefore deflected, causing it to move in a radial direction. In the method according to the invention, this has the advantage that the momentum of the liquid impinging upon the inlet stage acts substantially in an axial direction. Forces in a radial direction, by which the pump could be made to vibrate, are largely avoided. In this context, it is extremely advantageous if the channels are distributed uniformly over the circumference of the rotor.

Since the driving power during operation at overspeed is low, the pump is braked rapidly as soon as the liquid has entered the inlet stage. Before the liquid enters the subsequent stages provided with an impeller and a side channel, the speed has already significantly decreased, with the result that the subsequent stages are exposed to the shock load to only a reduced extent.

The side-channel pump according to the invention is provided with a controller, which is designed to operate the pump at an overspeed when the working chamber of the pump is filled with gas and to reduce the speed to an operating speed when liquid enters the pump. It is possible for the controller to be set up in such a way that it effects active braking of the pump. However, this is not necessary. As soon as liquid enters the pump, resistance increases, with the result that the speed of the pump then also decreases if the driving power remains unchanged. Normally, the drive motor is designed in such a way that it cannot keep the pump at the overspeed, even when operating at maximum power, once liquid has entered the pump. The controller can therefore be set up in such a way that, after entry of the liquid, it waits until the speed has decreased by itself to the desired operating speed and then increases the driving power, thus ensuring that the pump is held constantly at the operating speed.

The pump can be designed in a multistage way if a plurality of working chambers provided with side channels is arranged in series. An impeller is arranged in each working chamber, wherein the working chamber, the impeller and the side channel can be of conventional configuration. The inlet stage of the pump can be designed as a centrifugal stage. The pump can be enhanced with further features, which are described with reference to the method according to the invention.

A preferred area of use of the method according to the invention and the pump according to the invention is the pumping of liquefied gas from a tank. This takes place at LPG refilling stations, for example, where vehicles operated with liquefied gas are refueled from a tank, which is frequently sunk into the ground. The tank is partially filled with liquefied gas in the liquid state, while the upper part of the tank and, in particular, the line leading to the pump according to the invention are occupied by evaporated liquefied gas. The pressure in the tank and the line thus corresponds to the vapor pressure of the liquefied gas when the pump is not in operation.

If the pump is put into operation, the vapor of the liquefied gas is drawn in. This initially has the effect that the pressure in the line falls and, as a result, further liquefied gas goes into the gaseous state. If the pump has only a low suction power, this continues and only the newly evaporated gas is pumped in a continuous manner. However, the suction power of the pump according to the invention is sufficiently large to ensure that a reduction of the temperature in the line is also achieved, this having the effect that the vapor pressure in the line is lower than the vapor pressure in the tank. Owing to the pressure difference, the liquid rises from the tank into the line and can be drawn in by the pump. With the method according to the invention, it is therefore possible to pump the liquefied gas out of the tank even in liquid form. This works even when the tank is arranged lower than the pump and the line which extends to the pump from the tank is therefore a riser line, through which the liquefied gas has to be pumped against the force of gravity. As soon as the liquid impinges upon the inlet stage of the pump, the speed of the pump decreases from overspeed to the operating speed, and the liquid is pumped in the conventional mode of the pump.

BRIEF DESCRIPTION OF THE DRAWINGS

The invention is described by way of example below by means of advantageous embodiments with reference to the attached drawings, in which.

DETAILED DESCRIPTION

Figure 1:
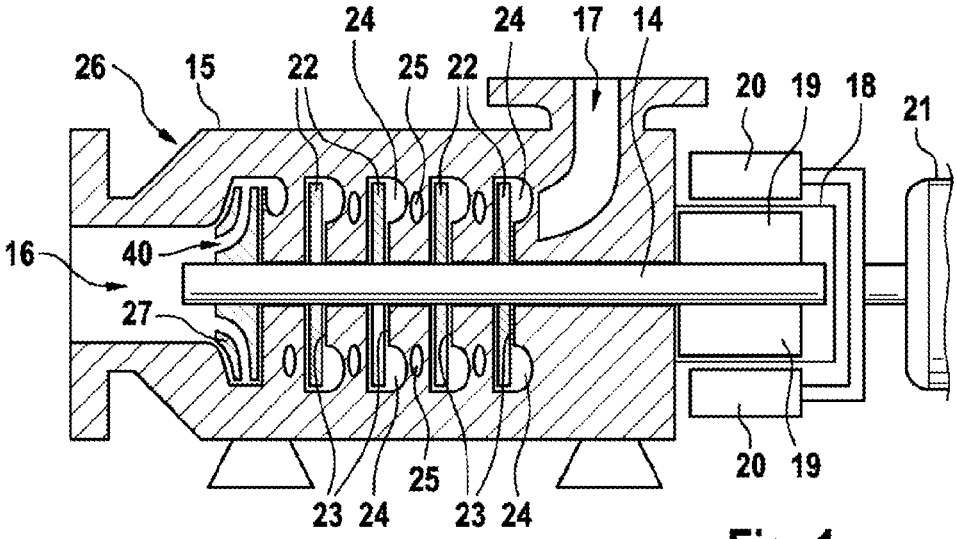
FIG. 1: shows a schematic illustration of a side-channel pump according to the invention.

In the case of a side-channel pump according to the invention in FIG. 1, a shaft 14 is rotatably mounted in a pump casing 15. The pump casing 15 is provided with an inlet opening 16 and an outlet opening 17, wherein the inlet opening 16 is arranged concentrically with the shaft 14. The opposite end of the pump casing 15 from the inlet opening 16 is designed as a split cage 18, within which there are arranged magnet elements 19, which are connected to the shaft 14. Magnet elements 20 are arranged outside the split cage 18, said elements being connected to the output shaft of an electric motor 21. The electric motor 21 is provided with a controller 35.

If the electric motor 21 is put into operation, the magnet elements 20 perform a rotary motion around the split cage 18. Through transmission of the magnetic forces, rotation is also imparted to the shaft 14, with the result that it rotates synchronously with the output shaft of the electric motor 21. Since one end of the shaft 14 issues into the inlet opening 16 and the other end of the shaft 14 is accommodated in the split cage 18, the pump is sealless in the sense that there is no point at which the interior and exterior of the pump are separated solely by a shaft seal. This has the advantage that the pumped medium can be reliably prevented from escaping.

The pump according to the invention comprises four stages, in each of which an impeller 21 rotates in a working chamber 23. The impellers 22 have vanes arranged in a star shape with open vane interspaces, which are closely surrounded by the casing 15. Axially adjacent to the impeller 22, the casing 15 forms a side channel 24, which is open toward the impeller 22 and in which the pumping medium is pumped through exchange of momentum with the impeller 22. The inlet end of the side channel 24 lies opposite an inlet opening, formed in the casing, of the working chamber 23, which is not visible in FIG. 1. The medium entering through the inlet opening passes through the interspaces of the vanes to the side channel 24. A channel 25, indicated only schematically in FIG. 1, in each case extends from the outlet opening of the preceding working chamber 23, through the pump casing 15, as far as the inlet opening of the following working chamber 23. The pumped medium thus passes through the four stages of the pump in succession.

The inlet stage 26 of the pump is configured as a centrifugal stage. A rotor 27 connected to the shaft 14 is provided with channels 40, which extend from a central region to a peripheral region of the rotor 27. The medium entering the channels 14 in the central region is moved outward by the centrifugal force. A channel extends from the outer end of the rotor 27, through the pump casing 15, to the inlet opening of the first working chamber 23.

The pump is designed to pump liquids. For this purpose, the pump is operated at a speed of 3000 rpm, for example, and the liquid is pumped with a volume flow of 35 $m^3$/h, for example.

Figure 2:
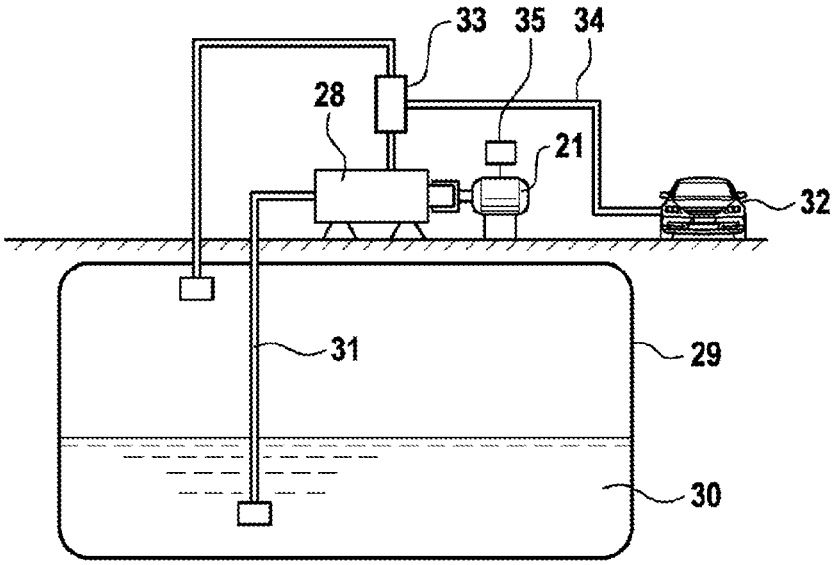
FIG. 2: shows an arrangement comprising a side-channel pump according to the invention and a liquefied gas tank.

In the example of use shown in FIG. 2, the pump 28 according to the invention is connected to a liquefied gas tank 29. A riser line 31 extends from the lower part of the tank 29 toward the inlet opening 16 of the pump 28. A line 34 is connected to the outlet opening 17 of the pump 28 and leads to a vehicle 32 which is to be refueled with liquefied gas 30. The volume flow of the pump is sufficiently great to ensure that it cannot be completely absorbed by the car 32. Gas bubbles are separated from the volume flow in a separator 33 and returned to the tank 29.

The tank 29 is about one third full of liquefied gas 30. The remaining space in the tank 29 and in the riser line 31 is filled with evaporated liquefied gas, and the pressure consequently corresponds to the vapor pressure of the liquefied gas. If the pump 28 is put into operation, starting from this state, the liquefied gas initially enters the pump 28 in the gaseous state. Since liquefied gas continues to evaporate with the application of reduced pressure in the tank 29, the suction power of the pump in this phase must be sufficiently large in order nevertheless to draw in liquefied gas in the liquid state through the riser line 31. According to the invention, this is achieved by virtue of the fact that, in this phase, the pump is operated with an overspeed which is significantly above the operating speed. The overspeed with which the pump is operated, as it were as a blower, can be 7000 rpm, for example. This speed is significantly above the maximum speed at which the pump can be operated when liquid is being pumped.

Despite the higher speed, the power of the pump when it is being operated as a blower is lower than in normal operation, in which liquid is being pumped. If, therefore, a low power is sufficient to accelerate the pump to the overspeed, it follows that the working chambers 23 of the pump are filled with gas. Consequently, the controller 35 is designed to operate the electric motor 21 at low power in the case of the overspeed.

As soon as liquid enters the pump, the resistance increases abruptly and the pump is braked. The controller 35 is designed in such a way that it increases the power of the electric motor 21 as soon as the pump 28 is braked to the operating speed in order to keep the pump at this speed. This operating state is maintained until the car 32 has been fully refueled. As soon as this is the case, the pump 28 is switched off.

When the pump is stationary, liquefied gas which is still in the pump evaporates continuously, with the result that the working chambers 23 return to the initial state, in which they are filled with gas, after a sufficiently long waiting time. If another car is to be refueled, the pump can be accelerated again at low power to the overspeed. On the other hand, if the next refueling operation takes place before the liquid has evaporated from the pump, the resistance is significantly higher, and the pump is operated with a high power at the operating speed from the outset, thus allowing liquid to be pumped.

Figure 3:
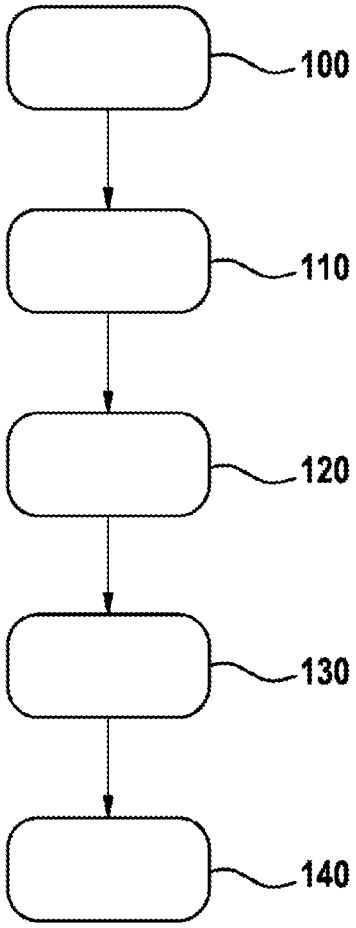
FIG. 3: shows a block diagram of the method according to the invention.

In FIG. 3, the method according to the invention is shown in schematic form. At the beginning of the method, a car 32 to be refueled is connected to a line 34 of the arrangement according to the invention in step 100. In step 110, the pump 28 is accelerated at low power to a speed of 7000 rpm. As soon as liquid enters the pump, the pump is braked and the controller 35 is designed to set the power of the electric motor 21 in such a way in step 120 that the speed of the pump 28 is held constant at the operating speed of 3000 rpm. Once the car 32 has been fully refueled, the pump 28 is switched off in step 130. In step 140, the line 34 is separated from the car 32, and the refueling process is ended.

The invention claimed is:

1. A method for operating a side-channel pump, said method comprising a. providing a side-channel pump in which an impeller rotates in a working chamber provided with a side channel, the side-channel pump having an operating speed when pumping liquid and a maximum speed at which the side-channel pump can pump liquid, said operating speed being no greater than said maximum speed;

b. operating said side-channel pump at an overspeed when said working chamber is filled with a gas, said overspeed being greater than said operating speed; and c. reducing the speed of said side-channel pump to said operating speed when said working chamber is filled with liquid.

2. The method of claim 1, wherein the overspeed of step b. is at least 50% greater than said operating speed.

3. The method of claim 1, applying a first driving power to said side-channel pump in step a. and applying a second driving power to said side-channel pump in step b., said first driving power being less than said second driving power by at least 10%.

4. The method of claim 1, wherein said operating speed is between 1200 rpm and 4000 rpm.

5. The method of claim 1, wherein the overspeed is between 3600 rpm and 7000 rpm.

6. The method of claim 1, wherein said operating speed is in the range of 1200 rpm to 2000 rpm and said overspeed is in the range of 3600 rpm to 5000 rpm.

7. The method of claim 1, wherein said operating speed is in the range of 2000 rpm to 4000 rpm and said overspeed is in the range of 5000 rpm to 7000 rpm.

8. The method of claim 1, wherein the side-channel pump is a sealless side-channel pump where a driven end of a shaft of said side-channel pump is arranged completely within a casing of said side-channel pump.

9. The method of claim 1, wherein the side-channel pump comprises a plurality of working chambers provided with a side channel.

10. The method of claim 1, wherein an inlet stage of said side-channel pump is configured as a centrifugal stage.

11. The method of claim 10, wherein said centrifugal stage comprises a rotor within which a plurality of channels extend from a central region to a peripheral region of said rotor.

12. The method of claim 11, wherein said plurality of channels are distributed uniformly over the circumference of the rotor.

13. The method of claim 1, wherein said side-channel pump is employed to pump liquefied gas out of a tank through a line at least partially filled with evaporated gas in a gaseous state and wherein step b. pumps said evaporated gas to draw said liquefied gas through said line and into said side-channel pump.

14. A side-channel pump comprising:

an impeller which rotates in a working chamber provided with a side channel;

a motor arranged to apply driving power to said impeller; and a controller arranged to deliver driving power to said motor to rotate said impeller at a an operating speed when pumping liquid, said side-channel pump having a maximum speed at which the side-channel pump can pump liquid, said operating speed being no greater than said maximum speed, wherein said controller is configured to operate said side-channel pump at an overspeed greater than said operating speed when said working chamber is filled with gas and to reduce the rotational speed of said side-channel pump when liquid enters said working chamber.

15. The side-channel pump of claim 14 in combination with a liquefied gas tank connected to an inlet opening of the side-channel pump.

16. The side-channel pump and liquefied gas tank of claim 15, wherein the liquefied gas tank is below the side-channel pump.

17. The side-channel pump of claim 14, comprising an inlet stage configured as a centrifugal stage.

18. The side-channel pump of claim 14, wherein said impeller is carried on a shaft arranged within a casing of said side-channel pump, said shaft being magnetically coupled to said motor.

19. The side-channel pump of claim 14, comprising a plurality of impellers rotating in a plurality of working chambers, said working chambers fluidly connected in series so that gas or liquid being pumped passes through the plurality of working chambers in succession.

* * * * *